US006578839B1

(12) United States Patent
Gerstenberg et al.

(10) Patent No.: US 6,578,839 B1
(45) Date of Patent: Jun. 17, 2003

(54) METHOD AND DEVICE FOR REMOVING FLAT PACKAGES FROM A PILE

(75) Inventors: Frank Gerstenberg, Berlin (DE); Hauke Luebben, Radolfzell (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/762,492

(22) PCT Filed: Aug. 2, 1999

(86) PCT No.: PCT/DE99/02405

§ 371 (c)(1),
(2), (4) Date: Mar. 26, 2001

(87) PCT Pub. No.: WO00/07744

PCT Pub. Date: Feb. 17, 2000

(30) Foreign Application Priority Data

Aug. 7, 1998 (DE) ..... 198 35 828

(51) Int. Cl.[7] ..... B65H 3/04; B65H 7/14

(52) U.S. Cl. ..... 271/10.03; 271/265.02; 271/270; 271/202; 271/34

(58) Field of Search ..... 271/10.03, 265.02, 271/270, 202

(56) References Cited

U.S. PATENT DOCUMENTS 4,691,912 A * 9/1987 Gillmann ..... 271/10.02
4,893,804 A 1/1990 Sasage et al. ..... 271/3.1
5,056,771 A * 10/1991 Beck et al. ..... 271/10.03
5,423,527 A * 6/1995 Tranquilla ..... 271/10.02
5,461,468 A * 10/1995 Dempsey et al. ..... 271/259
5,692,742 A 12/1997 Tranquilla ..... 271/10.03
5,813,327 A * 9/1998 Freeman et al. ..... 101/232
6,076,821 A * 6/2000 Embry et al. ..... 271/10.01

FOREIGN PATENT DOCUMENTS

DE 196 07 304 C1 7/1997 ..... B07C/1/04
JP 6-183602 * 5/1994
WO WO 98/24719 6/1998 ..... B65H/5/34

* cited by examiner

*Primary Examiner*—Donald P. Walsh
*Assistant Examiner*—Jonathan R. Miller
(74) *Attorney, Agent, or Firm*—Philip G. Meyers

(57) ABSTRACT

The invention pertains to a method for removing flat mail pieces from a pile by means of a removal device with controllable removal velocity which feeds the mail pieces to conveyor belts driven at the velocity $v_0$. Set velocity value profiles are associated with the differences between set and actual gaps. Since the curve forms are selectable, the drive ratios can be taken into account. The association of the set velocity value curves of the drive unit with the actual gaps in order to achieve the set gap at the takeover point of the conveyor belts at velocity $v_0$ takes place in previous measurements.

Figure 1:
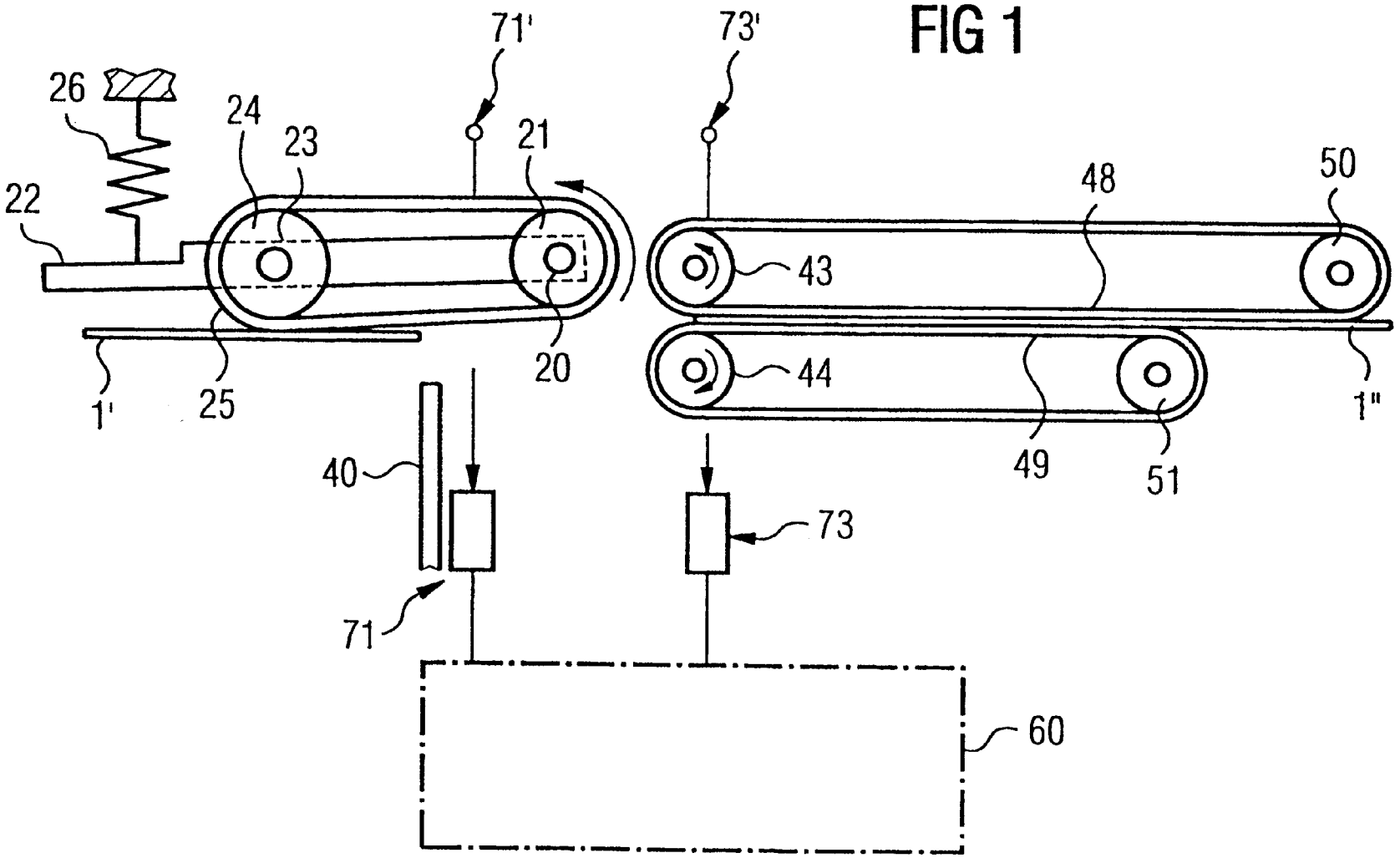

The nonlinearities of the transfer function of the drive unit are detected by tabular assignment of the velocity profiles on the basis of measurements.

13 Claims, 2 Drawing Sheets

METHOD AND DEVICE FOR REMOVING FLAT PACKAGES FROM A PILE

DESCRIPTION

The invention pertains to a method and a device for removing flat mail pieces from a pile according to the preamble of the independent claims.

The removal of the frontmost mail pieces from a pile of mail pieces must be done while maintaining a certain minimum gap [between mail pieces]. It is not desirable to fall below this minimum gap in order to permit downstream system components to process the individual mail pieces. At the same time, the mean gap which is achieved should exceed the minimum gap by as little as possible in order to achieve a high mail piece throughput.

Devices for removing flat mail pieces from a pile are known from EP 0 167 091 A1 and DE 196 07 304 C1. These devices have a controlled removal element that removes the frontmost mail piece of a pile and pushes it forward into the capture range of a pair of driven conveyor rollers, with a measurement section located between the pile outlet and the conveyor rollers in the form of a light barrier row whose output signals are fed to a control circuit. In EP 0 167 091 A1, the driving of the removal element for the removal of a mail piece takes place such that the spacing between the mail piece to be removed and a mail piece that has already been removed is ascertained and the respective spacing measurement result is corrected by a specified value that is dependent on the acceleration travel of an object to be removed and wherein the removal is initiated whenever the size of the thus corrected spacing measurement result matches a set spacing value.

The use of the specified value here permits only a global consideration of the transfer behavior of the removal drive units and their effect on the acceleration process.

Differing behavior of the mail pieces in the removal process also results from the differing positions of the mail pieces in the pile from which the mail pieces are removed. This likewise results in differing gaps, whereby throughput losses are created.

According to DE 197 07 304, therefore, the mail piece to be removed is first accelerated to an intermediate velocity which is lower than a prescribed final velocity, for a more precise control of gaps. As soon as the actual spacing is equal to the set spacing, the mail piece is accelerated to the final velocity.

These known solutions require an elaborate measurement section in the form of a light barrier row, with which both the position of the removed mail piece (back edge, as long as it is still located inside the measurement section) and that of the next mail piece to be removed (front edge) are continually detected in order to ascertain the correct points in time for the acceleration of the mail piece to be removed. Transfer characteristics of the removal drive unit are taken into account only globally.

The invention specified in the independent claims is thus based on the problem of creating a method and a device for removal of flat mail pieces from a pile with a defined final velocity in which a measurement section of linked sensors for detecting the mail pieces is not necessary and the deviations of the established gaps between the mail pieces are kept small with little effort.

The invention is based on the concept of associating gap differences from the set gap value with certain profiles of set velocity values. Since these waveforms are selectable, the drive conditions can be taken into account with them. The association of the set velocity value curves of the drive unit with the actual gaps in order to achieve the set gap at the takeover point of the conveyor belts takes place in previous measurements. The nonlinearities of the transfer function are covered empirically on the basis of the measurements, not algebraically, by a tabular association of the set and actual profiles. Thus there is no necessity for algorithmic description and the corresponding computational treatment. Arbitrarily complicated nonlinearities thus become easily manageable with a reproducible behavior. The run-time computational conditions during real-time operation are thus alleviated by virtue of the fact that the above associations are detected offline and represented in the tables.

Advantageous embodiments of the invention are specified in the subordinate claims.

Figure 2:
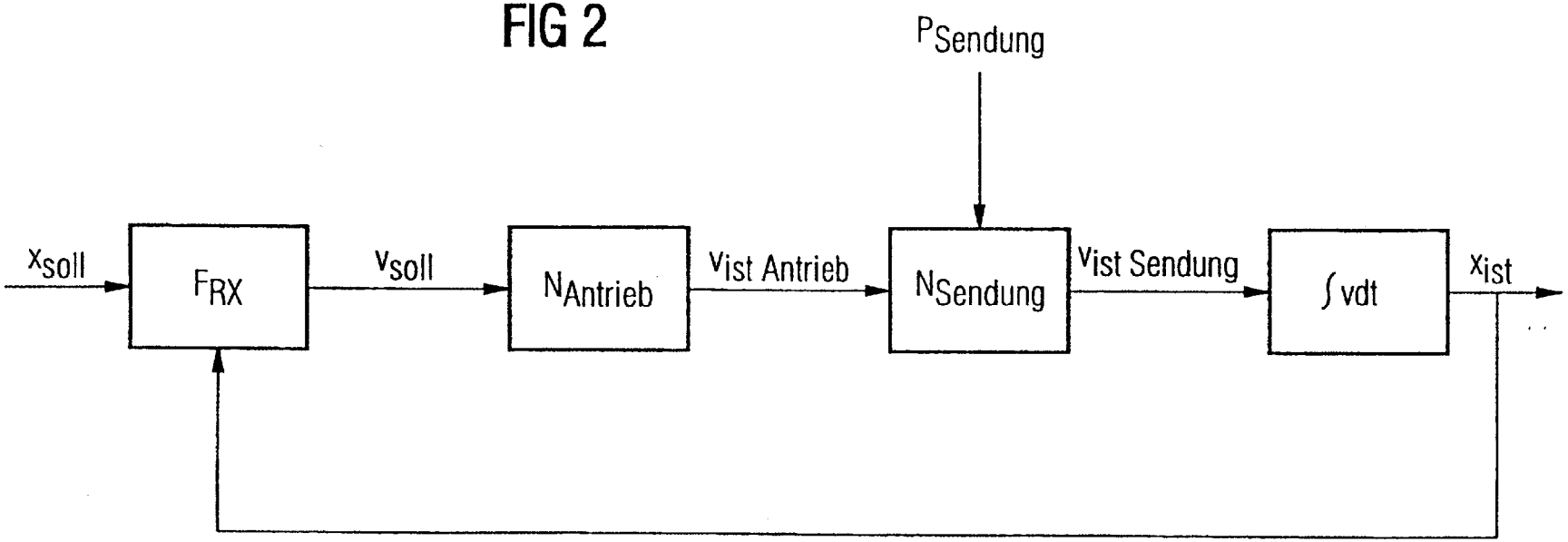

The invention is explained in greater detail below on the basis of drawings. These show FIG. 1, a device according to the invention;

FIG. 2, a control system block schematic diagram of the solution according to the invention.

FIG. 1 shows a preferred embodiment of a device according to the invention. A shaft 20 on which a roller 21 is fastened is provided here, firmly seated but free to rotate. The shaft 20 also serves for the pivotable seating of a crank 22 which supports the shaft 23 of an additional roller 24. At least one takeoff belt 25, whose outer surface has a high coefficient of friction, is guided around the roller 21 and the takeoff roller 24.

The crank 22 is supported by a schematically indicated spring 26 so that its respective position depends on the pressing force of the mail piece pile, of which the foremost mail piece 1' is shown while it is being removed. The free end of the crank 22 acts on a microswitch, not shown. If the pressing force of the pile is too low, then a break contact of the microswitch closes, whereby a geared motor is turned on. The latter drives a support wall in the direction of the takeoff roller 24 sufficiently long until the aforementioned break contact again turns off after the position of the crank corresponding to the specified pressing force is reached.

The shaft 20 is driven controllably by a servomotor, not shown, in the direction of the arrow. The edges pointing in the conveyance direction, i.e., the front edges of the mail pieces located in the pile, lie more or less tightly against a stop wall 40, which leaves a gap with respect to the takeoff belt 25, namely, the mail piece outlet.

In the conveyance path of the mail pieces, a pair of constantly driven conveyor rollers 43 and 44 is arranged, through which the mail pieces are forcibly conveyed onward at velocity $V_0$ as soon as they have reached their intake area. These conveyor rollers serve here as deflection rollers of conveyor belts 48 and 49 that are led in the conveyance direction around additional deflection rollers 50 and 51. While the driven conveyor roller 43 is solidly seated, the conveyor roller 44 is seated so as to yield on, for instance, a pivoting lever, not shown in the drawing, however, for the sake of simplicity.

Along the conveyance path of the mail pieces, a first light barrier 71/71' is arranged following a stop wall 40 as a sensor for detection of mail pieces; the light receiver is labeled with reference numeral 71 and its associated light source with 71'. Photodiodes or phototransistors are used as light receivers. This light barrier 71/71' is located sufficiently far downstream of the stop wall 40 that the mail pieces have reached the takeoff velocity $V_0$ at that point.

A second light barrier 73/73' monitoring the intake area of the conveyor rollers 43 and 44, with a light source 73', is also provided.

The light barrier signals are evaluated by the microprocessor of a control circuit 60. The respective positions of the mail pieces 1' and 1" are ascertained from the light/dark signals of the light barriers.

As soon as the control circuit 60 issues the removal command the takeoff motor is turned on and the first mail piece started. When its front edge reaches the second light barrier 73/73', the takeoff motor is immediately stopped and the mail piece is removed by the conveyor belts 48 and 49. The takeoff motor is only turned on again when the following condition is met: the first light barrier 71/71' becomes bright.

The takeoff drive is turned back on again in order to accelerate the next mail piece. As soon as its front edge reaches the first light barrier 71/71', the 1' mail piece has the velocity $V_0$ in this positioning phase and the distance from the previously removed mail piece and hence the deviation from the set gap are known.

For the acquisition of the parcel gaps, the position of the rear edge of the parcel that has been removed and seized by the conveyor belts 48, 49 is ascertained by means of a clock generator which forms a path clock signal. The front edge of the parcel to be removed is determined by integration of the actual drive velocity value. In order to take account of the slippage, a synchronization of the parcel positions can take place at additional light barriers, not shown.

As can be seen from FIG. 2, the removal method contains a discontinuous position regulation with underlying speed regulation, each of which is carried out at discrete points in time (front edge reaches first light barrier 71/71').

Symbols here have the following meanings:

$x_{soll}$ set gap $x_{ist(X)}$ actual gap on reaching the first sensor 71/71'

$F_{Rx}$ linear position regulation function (assignment tables)

$v_{soll(t)}$ actual velocity value=guidance function of the drive unit

N(Antrieb) nonlinear transfer function of the drive unit and the belts $v_{istAntrieb}$ actual value of the drive unit velocity $P_{Sendung}$ mail piece parameters (mass, surface characteristics, . . . )

N(Sendung) nonlinear transfer function of the belt/mail piece $v_{istSendung}$ actual value of the mail piece velocity The drive unit, with the current regulation function of the drive unit contained in it, is considered here as a black box; the current regulation function (e.g., a hardware circuit) is viewed as being nonparametrizable and is contained in the nonlinear velocity transfer function N(Antrieb). The actual velocity values of drive unit and belt were assumed to be identical and possible harmonic effects, in which higher derivatives $d^xv/dt^x$ would be involved as well as the first derivative, were ignored.

A defined curve profile of the set drive velocity value is assigned to each gap difference value (in the scale dimensions of the clock generator). This difference can be equal to 0 (in the exceptional case), larger or (as a rule) smaller:

Equal to 0 (actual gap=set gap):

If the existing gap corresponds exactly to the set gap, the mail piece can be moved forward uniformly at $v_0$ to the takeover point.

Greater than 0 (actual gap>set gap):

If the existing gap is already larger than the set gap, there is an attempt to make up the gap distance with a velocity that is increased in relation to $v_0$, that is to say, the curves of this bundle lie above $v_0$. Reasons for this case may be: delayed seizure of the mail piece from the takeoff belt due to an angled position, elevated slippage during the positioning phase due to surface characteristics and large mass, strong offset of the front edge from the normal position due to careless stacking.

Less than 0 (actual gap<set gap):

The existing gap is normally smaller than the set gap. Then the mail piece is decelerated through the course of a curve that lies underneath the $v_0$ straight line.

Since the time crucial to the adjustment of the gap, in which the mail piece is transported from sensor 71/71' to the intake point of the belts 48,49, corresponds to the integral of the reciprocal time over the path, the velocity profile V(x) is not determined and infinitely many solutions are mathematically possible.

Possible curve profiles are briefly discussed below. If step functions with varying lengths of time are chosen as set value profiles, then the takeoff belt velocities do not have step-shaped curves, due to damping effects of the drive unit, but they do have strong acceleration values.

The transfer function N(Sendung) depends on the mechanical properties of the mail piece, in particular, its mass and the nature of its surface. The risk that slippage may occur due to overcoming of static friction is greater the steeper the velocity curve of the belt is (that is, the greater the peak values of dv/dt are).

Therefore a set value profile with only step functions is not optimal, and linear ramps offer themselves as ideal functional components of the actual value of the belts. For establishing the set value functions it should be noted that a servodrive optimized for velocity and not position regulation typically possesses a transfer function which is attenuating in its small signal behavior. This has the consequence that, if pure ramps are used as set value parameters, a dead time or hyperboloid flattening results in the initial area, which must later be equalized by larger peaks of dv/dt.

For this reason, a combination of step and ramp functions is particularly advantageous for the set value function. With it, approximately ramp-like actual value profiles can be achieved for the following cases:

- for slight necessary enlargements of the existing gap, the actual value is lowered in a "V-shaped" curve to a minimal value greater than zero, or
- for a limit case the actual value is lowered in a "V-shaped" curve to the value zero, or
- for larger necessary enlargements of the existing gap, the actual value is lowered in a trapezoidal curve to the value zero, remains at this value for a time, and is again accelerated to the nominal value.

With regard to the set value profiles required for this, there is likewise a difference between those cases which do and do not remain at the value zero, in which the limit cases are not equal, due to the dead time characteristic which must be equalized. All cases can be described with the following formula for the outputs of the set value $v_{soll}$ at discrete points in time n (belt cycle rate):

$$V_{soll}=v_0/2-v_0/2T_1*t \text{ for } t<T_1$$

$$V_{soll}=0 \text{ for } T_1<=t<=T_2$$

$$V_{soll}=v_0/2+v_0/2(T_3_T_2)*(t-T_2) \text{ for } t>T_2$$

wherein t=0 is the point in time when the first light barrier 71/71' is reached $t=T_1$ is the time after which the set value has reached 0

$t=T_2$ is the time after which the jump to $v_0/2$ from the set value 0 takes place $t=T_3$ is the time at which the set value $v_0$ is again reached, where we have for typically similar behavior in the acceleration and deceleration cases $T_3=T_1+T_2$, and thus a symmetrical trapezoidal curve results.

In the example thus far, the set value profile to be used is established in each case upon reaching the sensor 71/71', and is used in the successive course of the removal phase of this mail piece without evaluation of the actual value of the mail piece. To achieve higher precision in maintaining the gaps, the following expansion makes sense: not just guidance parameter profiles, but also normative time-distance diagrams can be associated with the gap differences detected at sensor 71/71' to control the motion of the mail piece between the light barriers 71/71' and 73/73'. In case of leading or lagging motion of the mail piece deviating from the associated set value curve, therefore, it is possible to have recourse to likewise associated new set value curves for regulation purposes. In the simplest case, a set/actual value comparison could be undertaken at a single sensor roughly in the middle of the path and in case the actual value exceeds an upper tolerance value or if it falls below a lower tolerance value, a different, new set value profile could be output.

The effort for establishing these new curve profiles can be limited, since at this point it is not absolutely necessary to intervene with the greatest precision, but only with the correct tendency and without significant overshooting. In a particular case, even a fairly strong overshoot can be accepted and the overall behavior can nonetheless be improved: if the gap spectrum that is achieved without regulation contains a small component of excessively small gaps, because of which the set gap must be increased by an increment, the elimination of this component and thus a possible reduction of the set gap may have a large effect.

If, optionally, a light barrier row with, for instance, 10 light barriers is utilized, then the following modifications improving the gap quality are offered:

For larger decelerations, the method makes it possible to control braking to and remaining at velocity 0 for an arbitrarily long time via a respective set value curve. In terms of implementation technology, it is recommended, however, to lower the curve bundle only up to the variant in which the actual velocity value assuredly falls to 0 and otherwise to control the removal process in three phases: a braking phase with stored curve profile, a stationary phase in which there is continuous checking for the starting time, and an acceleration phase in which the mail piece is moved to the takeover point according to a stored curve profile. With a light barrier row, the place at which the mail piece has come to rest can be determined precisely up to the grid spacing, and the starting time and the associated set value curve can be determined as a function of it. In the unregulated operational variant, the light barrier row is necessary only in the phase of establishing the curve profiles.

The described method is based fundamentally on the assumption that the gap between two mail pieces arises before the front edge of the successive mail piece reaches the first sensor 71/71'. The exceptional case of double removals that open up [a gap] between the first sensor 71/71' and the takeover point will lead to gap enlargements without intermediately arranged sensors, because a front edge of the subsequent mail piece positioned immediately upstream of the takeover point must be assumed for security reasons. In the presence of additional sensors, they can be used in order to determine the position precisely up to the grid spacing and to establish the starting time and the associated set value curves as a function of it.

The association of the curve profiles with the gap differences and front edge positions in the removal takes place in two steps:

rough ascertainment in the foregoing measurement modes corrections on the basis of a larger database by means of process quality statistics.

There exists a respective method for the following process types:

1. Excessively Small Actual Gap

Mail pieces are removed individually. Various curves are successively traversed, starting from the limit case of uniform motion without change in the gaps, with an increasingly strong deceleration of the mail piece up to the limit case of an intervening stop and the time until light barrier 73/73' is reached is measured in each case.

2. Excessively Small Actual Gap with Strong Deviation

Mail pieces are moved with low velocity individually into the light barrier row and positioned at the possible positions of the front edge. After a brief stop, there is acceleration to $v_0$ according to a prescribed curve profile and measurement of the time until the light barrier 73/73' is passed.

3. Excessively Large Actual Gap

Individual mail pieces are removed but with curve profiles above $v_0$, starting once again from the limit case of uniform motion without change in the gaps up to the limit case at which the mail piece is moved at maximum slope to velocity $v_1$, and moved at this velocity up to and into the transport path.

Each of these measurement modes is carried out several times in the implementation and the curve associations are initially established from the mean values (rough measurement).

There exists an internal process quality statistics which records how often each individual process type and each curve profile as the result are executed separately for each process type and each curve profile, how often the light barrier 73/73' was reached in the set time and how often in positively or negatively deviating times (in belt cycle increments).

By means of these statistics, the relevance of the individual processes can be assessed and corrections of the curve profile associations undertaken, and thus the rough measurements relying on a small data base can be refined.

If the process quality statistics are always running, the adaptation of the set value curve associations can be conducted automatically. Possible advantages:

reduction of project-specific adaptation efforts, particularly for changes of removal speed to a limited extent, an automatic correction can be done in case of changes in mechanical conditions.

What is claimed is:

1. A method for removing flat items from a pile by means of a removal device with a controllable removal velocity, comprising:

(a) feeding a first item by means of a drive unit from one end of the pile to a takeover point of a conveyor driven at a velocity $v_0$;

(b) feeding a second item from the one end of the pile to the conveyor when a rear edge of the first item has reached the takeover point of the conveyor;

(c) determining an actual distance between the rear edge of the first item and a first sensor located proximate the pile at a point in time when a front edge of the second item has reached the first sensor and the second item has reached the velocity $v_0$;

(d) repeating steps (a) to (c) while maintaining a set distance between successive items by activating a predetermined velocity value profile for the drive unit which corresponds to the actual distance, which profile is one of a plurality of stored set velocity value profiles for the drive unit of the removal device associated with differences between the set distance and actual distances for spacing between successive items for the removal process in order to maintain the set distance between the items after intake of the items by the conveyor, wherein the velocity profiles are established as a function of transfer behavior of the drive unit and for a defined terminal velocity, and wherein times that items require in the respective set velocity profile in order for a front edge of each item to move from the first sensor to the takeover point of the conveyor are determined in prior measurements for the association of the times with the differences between the set distance and the actual distances.

2. A method according to claim 1, wherein the terminal velocity of the set velocity value curve profile is equal to the velocity $v_0$.

3. A method according to claim 1, further comprising monitoring item motion progress during the removal process online, and if deviations of the actual times from the set times are detected, continuing removal with a different set velocity value profile according to the detected deviation.

4. A method according to claim 1, wherein the conveyor comprises a pair of parallel adjacent conveyor belts that receive each item at one end thereof and engage the items on opposite sides.

5. A method according to claim 4, wherein the distance of the rear edge of the first item captured by the conveyor belts from the first sensor at the point in time at which the front edge of the second item just reaches the sensor is ascertained by determining the time difference between detection of a rear edge of the first item by the first sensor and detection of the front edge of the second mail at the first sensor as well as from the velocity $v_0$ of the conveyor belts.

6. A method according to claim 5, wherein the time difference is determined by a clock generator.

7. The method according to claim 1, wherein the items are mail pieces.

8. A device for the removal of flat items from a pile, comprising:

a pair of conveyor belts drivable at a constant velocity and disposed to engage a flat item on opposite sides and transport the item;

a removal element including a drive unit for feeding flat items one at a time from one end of the pile to a takeover point of the conveyor belts;

a stop wall that holds the pile in position relative to the removal element;

first and second sensors for detecting the items, wherein the first sensor is located at a position between the stop wall and the takeover point at which an item being removed has reached a removal velocity $v_0$, and wherein the second sensor is located at the takeover point of the conveyor belts; and a control system for maintaining a set distance between items by controlling item removal times and velocities as a function of the respective distance between a first item removed from the pile and a second, succeeding item removed from the pile as calculated from removal velocity $v_0$ and a reading from the first sensor indicating that an edge of the second item has reached the first sensor.

9. The device of claim 8, further comprising a plurality of stored velocity value profiles for the drive unit, which profiles are each associated with differences between a set distance value and actual distance values for spacing between successive items, for maintaining a set distance between the items after intake of the items by the conveyor belts.

10. The device of claim 9, wherein the velocity profiles are established as a function of transfer behavior of the drive unit and for a defined terminal velocity of each item removed.

11. The device of claim 10, wherein the profiles are developed by measuring the times that items require in the respective set velocity value profile in order for the front edge of each item to move from the first sensor to the takeover point of the conveyor belts, as determined in prior measurements for the association of the times with the differences between the set distance value and actual distance values.

12. The device of claim 10, wherein the control system includes logic for stopping the drive unit when a front edge of an item being removed is detected by the second sensor and thereafter restarting the drive element when no item is detected by the first sensor.

13. A device according to claim 8, further comprising a clock generator for determining a position of a rear edge of a mail piece that has been removed from the pile and seized by the conveyor belts.

* * * * *